US005609476A

United States Patent [19]

Kim et al.

[11] Patent Number: 5,609,476

[45] Date of Patent: Mar. 11, 1997

[54] RECIPROCATING COMPRESSOR WITH FLOW PASSAGE CLOSED BY VALVE PRE-BIASED TO AN OPEN POSITION

[75] Inventors: Ki M. Kim; Sung T. Lee, both of Suwon, Rep. of Korea

[73] Assignee: Samsung Electronics Co., Ltd., Suwon, Rep. of Korea

[21] Appl. No.: 592,234

[22] Filed: Jan. 26, 1996

[30] Foreign Application Priority Data

Jan. 28, 1995 [KR] Rep. of Korea ..... 1995-1686

[51] Int. Cl.[6] ..... F04B 39/10

[52] U.S. Cl. ..... 417/447; 137/855

[58] Field of Search ..... 137/855, 856; 417/447, 559, 565, 569, 571

[56] References Cited

U.S. PATENT DOCUMENTS 4,127,362 11/1978 Fladby ..... 417/447

4,580,604 4/1986 Kawaguchi et al. ..... 137/856

4,642,037 2/1987 Fritchman ..... 417/447

*Primary Examiner*—John J. Vrablik

*Assistant Examiner*—Peter G. Korytnyk

*Attorney, Agent, or Firm*—Burns, Doane, Swecker & Mathis, L.L.P.

[57] ABSTRACT

A reciprocating compressor includes a piston reciprocating in a chamber. A valve plate disposed at one end of the chamber includes a fluid inlet orifice and a fluid discharge orifice. Each orifice is covered by a valve in the form of a resilient material check valve arranged so that a free end thereof covers the respective orifice. Each valve comprises a resilient material check valve anchored at an end opposite its free end. Each valve includes a cut-out forming a resilient portion pressed against the valve plate for pre-biasing the valve to an open position.

4 Claims, 6 Drawing Sheets

RECIPROCATING COMPRESSOR WITH FLOW PASSAGE CLOSED BY VALVE PRE-BIASED TO AN OPEN POSITION

BACKGROUND OF THE INVENTION

The present invention concerns a reciprocating compressor with a compression chamber used in an air conditioner, refrigerator, freezer and the like, and more particularly an intake and a discharge valve for respectively controlling a refrigerant flowing into the compression chamber through an intake orifice and discharged out through a discharge orifice.

Generally a reciprocating compressor used in a refrigerator is to compress a refrigerant with a high pressure, which then is cycled through condensation, expansion and evaporation. A conventional reciprocating compressor comprises, as shown in FIG. 4, a sealed housing 10 having an intake tube (not shown) and a discharge tube, a drive 30 provided in the housing for generating power, and a compression part 20. The drive 30 comprises a stator 31, a rotor 32, a rotating shaft 34 mounted to the rotor 32 by means of a pressure fit, and an eccentric shaft 33 integrally formed with the lower end of the rotating shaft. The compression part 20 further comprises a hollow cylinder block 22 mounted on the lower side of the drive 30 with both sides opened, a cylinder head 23 for closing one opened side of the cylinder block 22 to form a cylinder bore 21 to serve as a compression chamber, a piston 24 for reciprocating in the compression chamber 21 to intake, compress and discharge the refrigerant, and a connecting rod 25 extending into the other opened end of the cylinder to block for converting the eccentric rotational motions of the eccentric shaft 33 into rectilinear motions. In addition, the cylinder head 23 has an intake chamber 27 and a discharge chamber 26 for respectively guiding the intake and discharge of the refrigerant into and from the compression chamber 21. A main valve plate 50 is mounted between the cylinder head 23 and the cylinder block 22, having an intake value 2 and a discharge valve; as shown in FIG. 5, to selectively connect the compression chamber 21 with the intake chamber 27 or the discharge chamber 26.

In such a conventional reciprocating compressor, if the interaction between the stator 31 and the rotor 32 causes the rotating shaft 34 and thus the eccentric shaft 33 to rotate, the eccentric rotational motions of the eccentric shaft 33 are converted into the rectilinear reciprocating motions by the connecting rod 25, so that the piston 24 rectilinearly reciprocates in the compression chamber 21, thus sucking the refrigerant through the intake chamber 27 into the compression chamber 21, compressing and discharging it through the discharge chamber 26 into the inside of the sealed housing 10. The compressed refrigerant is finally supplied to the refrigerating system through a discharge tube (not shown).

The, the main valve plate 50 interposed between the cylinder block 22 and the cylinder head 23, has an intake orifice 51 and a discharge orifice 52 for respectively connecting the compression chamber 21 with the intake chamber 27 and the discharge chamber 26. An intake valve plate 54 having the intake valve 2 integrally formed is mounted on the inner side of the main valve plate 50 toward the compression chamber 21 so that the intake valve 2 may selectively open or close the intake orifice 51. On the other hand, the discharge valve 1 is mounted on the outer side of the main valve plate 50 toward the discharge chamber 26 so as to selectively open or close the discharge orifice 52 alternately with the opening or closing of the intake orifice 51. Additionally, there are gaskets 57 and 58 respectively mounted on both sides of the main valve plate 50 to prevent leakage of the refrigerant. The intake and discharge valves 2 and 1 are made of a resilient material to make it possible to open or close the intake and discharge orifices 51 and 52 according to the pressure variations of the compression chamber 21.

Moreover, referring to FIG. 6 for illustrating the structure of the discharge valve 2, one end part of the discharge valve 2 is mounted on the main valve plate 50 so that the other end can completely close the discharge orifice 52, and its opening range is restricted by a stopper 55 mounted over it. Also mounted over them is a keeper 56 to fix them.

In operation of such conventional intake and discharge valves, when the piston 24 is moved toward the left side (bottom dead center) with reference to FIG. 4, and the pressure of the compression chamber 21 becomes lower than that of the intake chamber 27, the intake valve 2 is opened toward the compression chamber 21, thus admitting refrigerant into the compression chamber. Then, when the pressure of the compression chamber 21 attains the same level to that of the intake chamber 27, the intake valve 2 resiliently returns to the original position to close the intake orifice 51. When the piston 24 keeps on moving toward upper dead center after passing bottom dead center, compressing the refrigerant, and the pressure of the compression chamber 21 becomes greater than that of the discharge chamber whereupon, the discharge valve 1 is opened to discharge the compressed refrigerant through the discharge orifice 52 to the inside of the sealed housing.

Such conventional intake and discharge valves suffer the drawbacks that oil films usually formed between the intake and discharge orifices and the intake and discharge valves impede the opening operation of the valves, thus requiring greater forces to open the valves than would otherwise be the case, so that the working efficiency of the compressor is reduced. Besides, the discharge valve is pressed by the stopper as shown in FIG. 6, requiring an additional force to open.

SUMMARY OF THE INVENTION

It is an object of the present invention to provide an intake and a discharge valve for use in a reciprocating compressor, which valves include a means to impart a resilient force prebiasing the values toward an open position.

It is another object of the present invention to provide a means for slightly separating the intake and discharge valves from the intake and discharge orifices so as to remove the oil films formed between the valves and the orifices, so that the amount of the forces (and electric power) required to open the valves is reduced.

According to an embodiment of the present invention, there is provided a reciprocating compressor, which comprises a sealed housing, a cylinder block with a cylinder head, a compression chamber formed in the cylinder block, a main valve plate having an intake orifice and a discharge orifice for respectively taking in and discharging a refrigerant, the main valve plate mounted between the cylinder block and the cylinder head, and an intake valve for controlling the refrigerant flowing into the compression chamber through the intake orifice, and a discharge valve for controlling the refrigerant discharged out through the discharge orifice, characterized in that at least one of the intake and discharge valves is provided with a resilient means for facilitating the opening thereof.

The present invention will now be described more specifically with reference to the drawings attached only by way of example.

DETAILED DESCRIPTION OF PREFERRED EMBODIMENT

Figure 4:
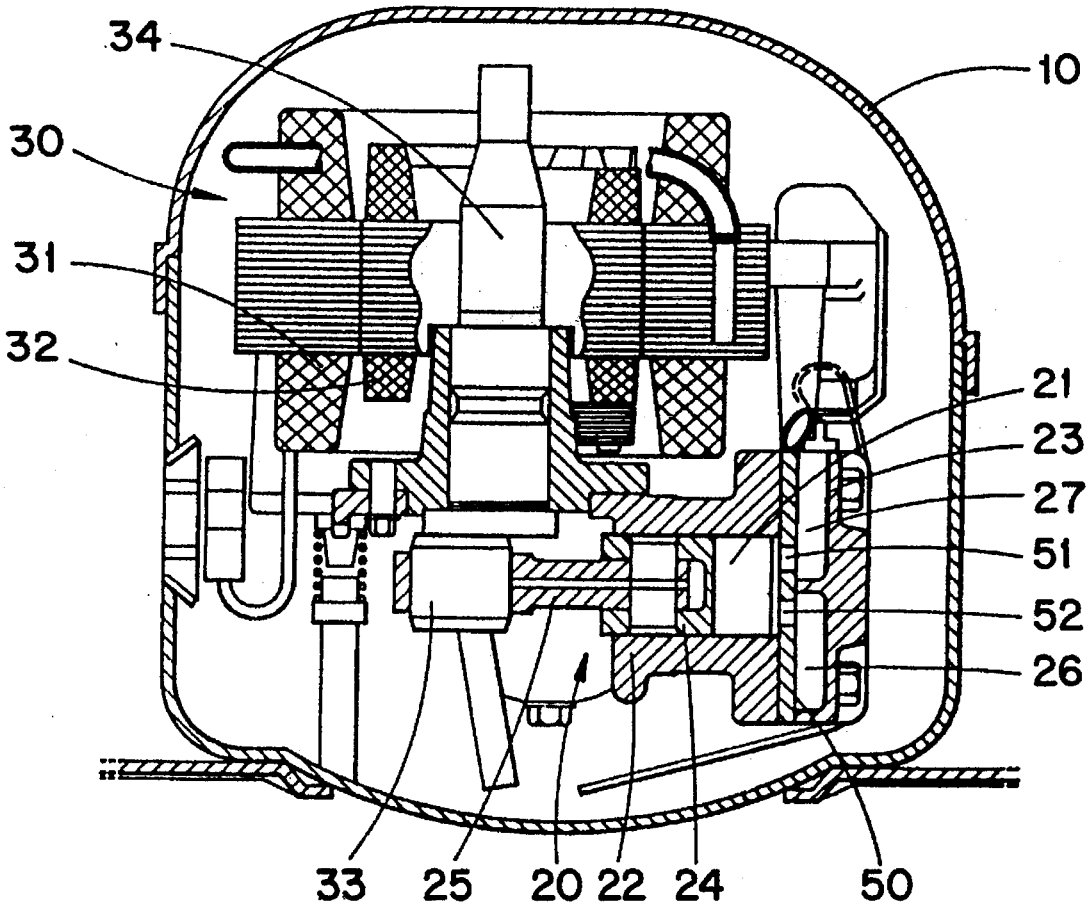
FIG. 4 (PRIOR ART)
FIG. 4 is a cross sectional view of the internal structure of a conventional reciprocating compressor.
Figure 5:
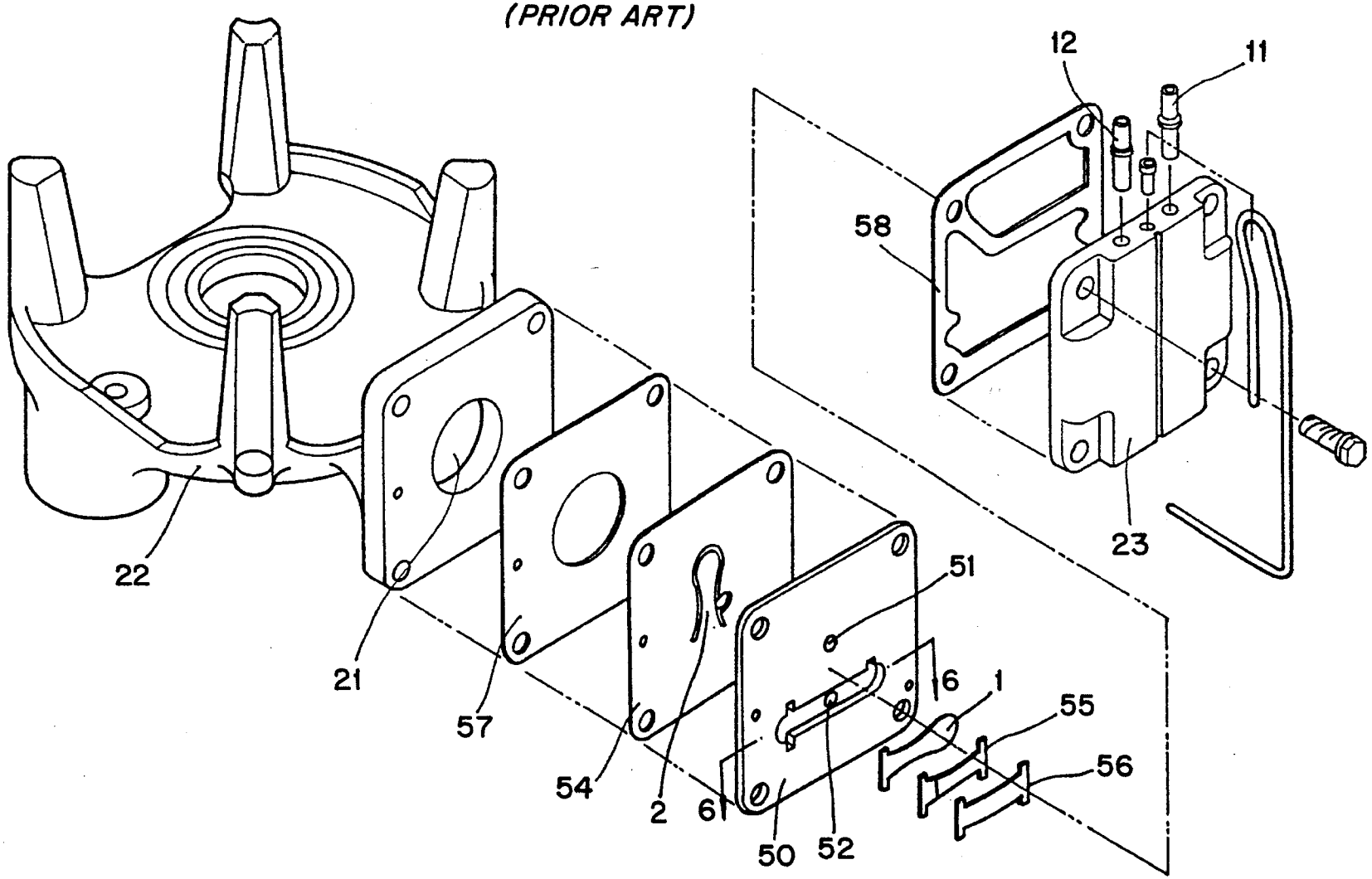
FIG. 5 (PRIOR ART)
FIG. 5 is an exploded perspective view of the compression part of FIG. 4.
Figure 6:
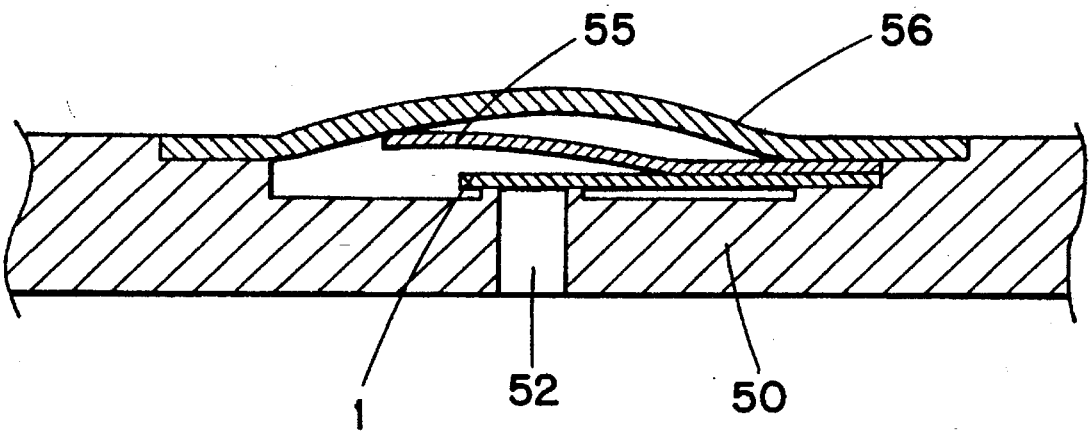
FIG. 6 (PRIOR ART)
FIG. 6 is a cross sectional view of the compressor depicted in a conventional discharge valve mounted on the valve plate taken along line 6—6 of FIG. 5.

Before describing a preferred a embodiment of the present invention with reference to the attached drawings, it is noted that the same reference numerals are used for the parts of the inventive structure corresponding to those of the conventional one shown in FIGS. 4–6.

Figure 1:
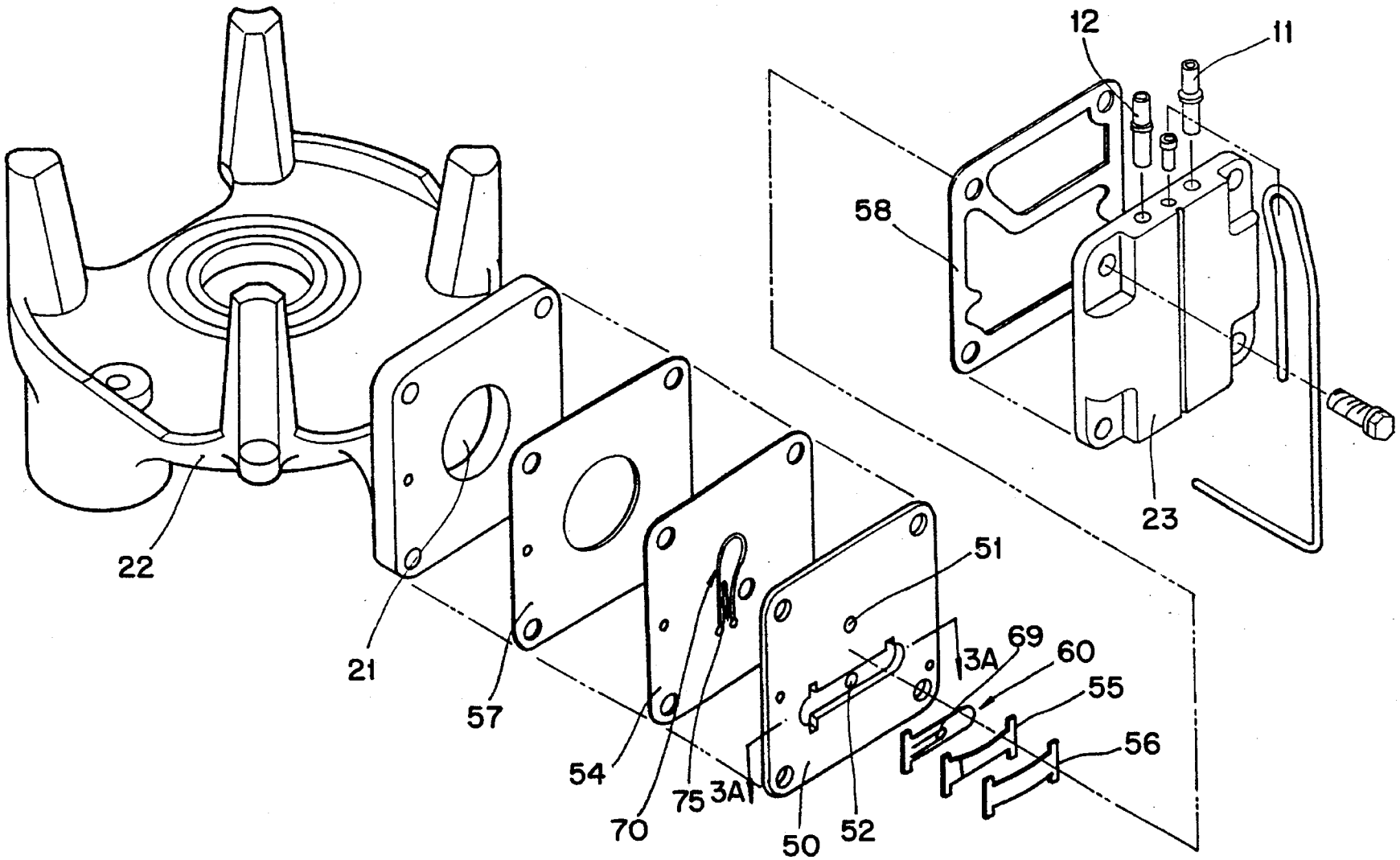
FIG. 1 is an exploded perspective view of the compression part of a reciprocating compressor provided with the inventive intake and discharge valves.

Referring to FIG. 1, the main valve plate 50 interposed between the cylinder block 22 and the cylinder head 23, has an intake orifice 51 and a discharge orifice 52 for respectively connecting the compression chamber 21 with the intake chamber 27 and the discharge chamber 26. An intake valve plate 54 having an intake valve 70 integrally formed is mounted on the inner side of the main valve plate 50 toward the compression chamber 21 so that the intake valve 70 acts as a resilient material check valve to selectively open or close the intake orifice 51. On the other hand, the discharge valve 60 is mounted on the outer side of the main valve plate 50 toward the discharge chamber 26 so as to act as a resilient material check valve to selectively open or close the discharge orifice 52 alternately with the opening or closing of the intake orifice 51. Additionally, there are gaskets 57 and 58 respectively mounted on both sides of the main valve plate 50 to prevent leakage of the refrigerant. The intake and discharge valves 70 and 60 are provided with resilient strips 75, 69 for facilitating their opening according to the present invention, which hereinafter will be more specifically described.

Figure 2A:
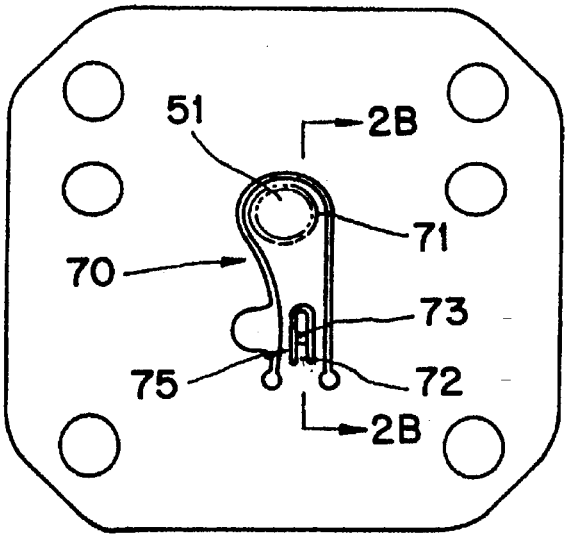
FIG. 2A is a bottom view of the intake valve of the present invention.
Figure 2B:
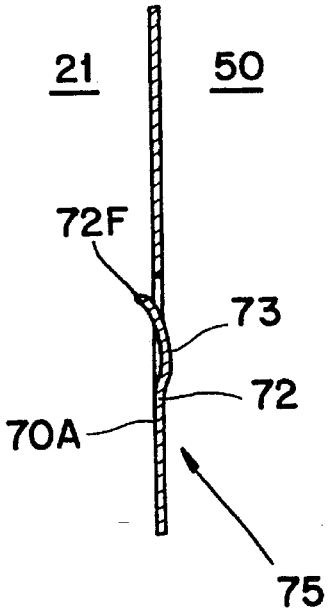
FIG. 2B is a cross sectional view taken along line 2B—2B of FIG. 2A.

Referring to FIG. 2A, the intake valve 70 is integrally formed with the intake valve plate 54 having the same outline as the valve plate 50. For example, the intake valve plate 54 is cut to form the intake valve 70 in the region corresponding to the intake orifice 51 so that the end portion of the valve is formed with a seat 71 to contact the intake orifice 51. The base 70A of the intake valve 70 is joined to the intake valve plate 54, and is positioned opposite to the seat 71. That base 70A is provided with a resilient strip 75 to facilitate the opening of the intake valve. The resilient strip 75 has a 72 connected to the base 70A of the intake valve 70. The auxiliary cut strip 75, as shown in FIG. 2B, is bent toward the compression chamber 21 to form a resilient zone 73 which is pressed against the value plate 50 so that the free end 72F of the auxiliary cut strip 72 is biased toward the compression chamber 21. Thus, the resilient strip 75 exerts a resilient force to slightly push on bias the intake valve toward the opening direction.

Figure 3A:
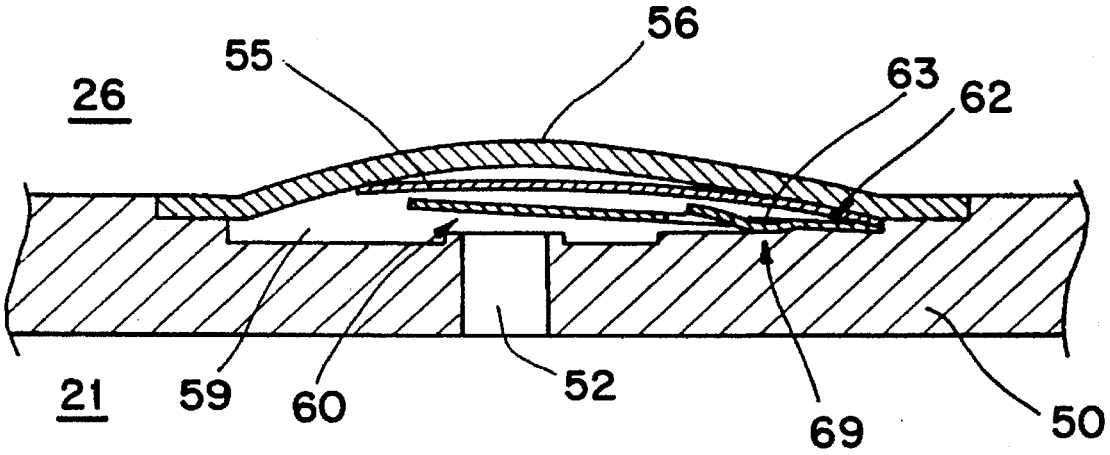
FIG. 3A is a cross sectional view of the inventive discharge valve mounted on the valve plate taken along line 3A—3A of FIG. 1.
Figure 3B:
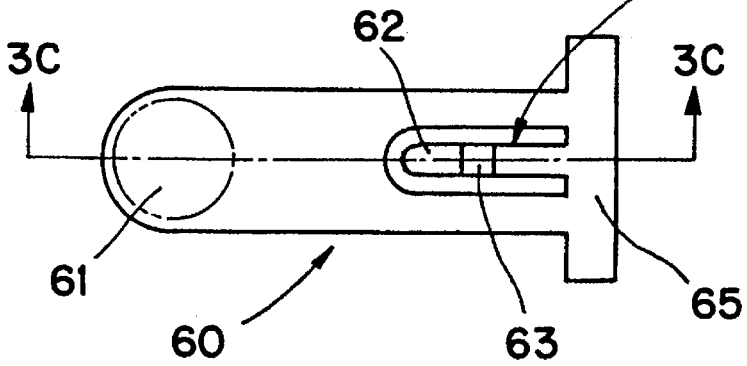
FIG. 3B is a plan view of the inventive discharge valve.
Figure 3C:
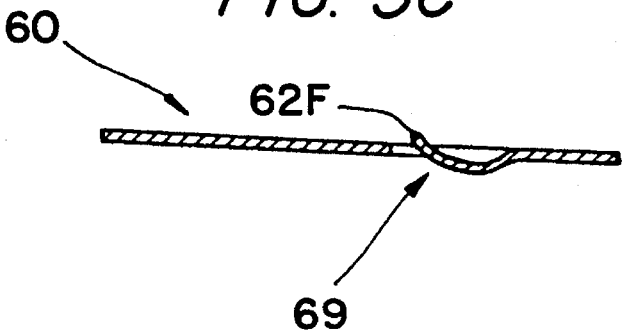
FIG. 3C is a cross sectional view taken along line 3C—3C of the FIG. 3B.

Referring to FIG. 3A, the discharge valve 60 is mounted in a mounting recess 59 formed on the outer side of the main valve plate 50 toward the discharge chamber 26, and defines a seat 61 formed in the region corresponding to the discharge orifice 52. The base 65 of the discharge valve 60 positioned opposite to the seat 61 is fixedly attached to the valve plate 50, as shown in FIG. 3A. The stopper 55 is mounted over the discharge valve 60 to restrict the opening range of the discharge valve 60. The base of the discharge valve 60 is secured by one end of the stopper 55, which in turn is securely positioned by the keeper 56.

The discharge valve 60 is provided with the resilient strip 69 to exert a slight resilient force on the discharge valve 60 so as to facilitate its opening. The resilient strip 69 has the same structure as the resilient strip 75 used in the intake valve 70, and therefore the description thereof is omitted. The bent resilient zone 63 of the resilient strip 69 contacts the surface of the main valve plate 50 slightly pushing the discharge valve 60 toward the discharge chamber, so that the seat 61 of the discharge valve 60 is slightly separated from the discharge orifice 52 except when the refrigerant is sucked into the compression chamber.

In operation, when the piston 24 is moved toward bottom dead center, and the pressure of the compression chamber 21 is reduced below the pressure of the intake chamber 27, the intake valve 70 is opened by the pressure difference. Meanwhile, the discharge valve 60 is moved toward the compression chamber 21 to close the discharge orifice 52 by overcoming the resilient force of the resilient strip. On the other hand, when the piston 24 is moved toward upper dead center to compress the refrigerant, the pressure of the compression chamber returns the intake valve 70 to close the intake orifice 51, while the discharge valve 60 is pushed toward the discharge chamber 26 by the pressure of the compression chamber to open the discharge orifice 52, so that the compressed refrigerant is supplied through the discharge chamber 26 to the inside of the sealed housing 10, and then through the discharge tube 11 to the refrigerating system. When the intake valve 70 and the discharge valve 60 are in the process of being opened, the resilient strips 75 and 69 serve to facilitate the opening operation, i.e., the strip 75 pre-biases the intake valve 70, toward the compression chamber 21 in the case of the intake valve and the strip 69 pre-biases the discharge valve 60 toward the discharge chamber 26.

As described above, the inventive valve structure inherently has a resilient force pushing, it toward the opening direction, so that the compressor saves some of the energy required to open the valves thus improving the working efficiency. Summarizing the operation of the inventive valves, the intake valve operated by the pressure difference between the compression chamber and the intake chamber receives the resilient force of the resilient strip toward the compression chamber, thus considerably reducing the amount of force required to open the intake valve. Moreover, the discharge valve is slightly separated from the discharge orifice by a given gap preventing the oil contained in the refrigerant from forming an oil film between the discharge valve and the discharge orifice, and also receives the resilient force of the resilient strip toward the discharge chamber, thus resulting in the reduction of the force required to open the valve. Consequently, the compressor saves the electrical energy improving the working efficiency.

What is claimed is:

1. A reciprocating compressor comprising a housing; a cylinder block forming a chamber; a cylinder head disposed at one end of the chamber; a valve plate disposed between the chamber and the cylinder head and forming an intake orifice and a discharge orifice for admitting and discharging, respectively, a refrigerant; an intake valve for opening and closing the intake orifice, a discharge valve for opening and closing the discharge orifice; at least one of the intake and discharge valves comprising a resilient material check valve having an inherent bias to a position closing its respective orifice; and a pre-biasing structure arranged to impose a pre-bias on the at least one valve urging the at least one valve to an open position, wherein the pre-biasing structure comprises a strip partially cut from the at least one valve and including a resilient zone engaging an element situated adjacent the at least one valve.

2. The compressor according to claim 1 wherein the element comprises the valve plate.

3. The compressor according to claim 1, wherein the pre-bias is sufficient to maintain the at least one valve in a partially open condition in a rest position of the at least one valve.

4. A reciprocating compressor comprising a housing; a cylinder block forming a chamber; a cylinder head disposed at one end of the chamber; a valve plate disposed between the chamber and the cylinder head and forming an intake orifice and a discharge orifice for admitting and discharging, respectively, a refrigerant; an intake valve for opening and closing the intake orifice, a discharge valve for opening and closing the-discharge orifice; at least one of the intake and discharge valves comprising a resilient material check valve having an inherent bias to a position closing its respective orifice; and a pre-biasing structure arranged to impose a pre-bias on the at least one valve urging the at least one valve to an open position, wherein the resilient material check valve is anchored at one end and has a free end opposite the anchored end, the pre-biasing structure comprising a strip cut from the resilient material check valve to act as a leaf spring having an anchored portion disposed adjacent the anchored end of the resilient material check valve, and a resilient portion pressed against the valve plate.

* * * * *